US010373531B2

(12) United States Patent
Rauma et al.

(10) Patent No.: US 10,373,531 B2
(45) Date of Patent: Aug. 6, 2019

(54) SIGNAGE SYSTEM FOR STRUCTURAL POLES

(71) Applicants: Jorma Rauma, British Columbia (CA); Harri Rauma, British Columbia (CA)

(72) Inventors: Jorma Rauma, British Columbia (CA); Harri Rauma, British Columbia (CA)

( * ) Notice: Subject to any disclaimer, the term of this patent is extended or adjusted under 35 U.S.C. 154(b) by 0 days.

(21) Appl. No.: 14/840,990

(22) Filed: Aug. 31, 2015

(65) Prior Publication Data

US 2016/0240114 A1 Aug. 18, 2016

Related U.S. Application Data

(60) Provisional application No. 62/043,997, filed on Aug. 29, 2014.

(51) Int. Cl.

| | |
|---|---|
| ***G09F 7/22*** | (2006.01) |
| ***G09F 19/04*** | (2006.01) |
| ***G09F 15/00*** | (2006.01) |
| *G09F 7/18* | (2006.01) |

(52) U.S. Cl.

CPC ..... *G09F 7/22* (2013.01); *G09F 15/0037* (2013.01); *G09F 15/0081* (2013.01); *G09F 19/04* (2013.01); *G09F 2007/1804* (2013.01); *G09F 2007/1873* (2013.01)

(58) Field of Classification Search

CPC .... G09F 7/22; G09F 15/0037; G09F 15/0081; G09F 2007/1804

See application file for complete search history.

(56) References Cited

U.S. PATENT DOCUMENTS

| | | | | |
|---|---|---|---|---|
| 960,316 | A * | 6/1910 | Hanlon | G09F 7/22 40/477 |
| 1,626,876 | A * | 5/1927 | Rosewater | G09F 7/22 40/480 |
| 3,210,872 | A * | 10/1965 | Glasgow | G09F 7/22 137/115.16 |
| 4,662,096 | A * | 5/1987 | Bayless | G09F 15/0037 40/607.03 |
| 5,782,027 | A * | 7/1998 | Gildea | G09F 23/00 40/538 |
| 6,061,939 | A * | 5/2000 | Gildea | G09F 23/00 40/538 |
| 2002/0053153 | A1* | 5/2002 | Nesbitt | G09F 15/0037 40/607.03 |
| 2003/0164431 | A1* | 9/2003 | Kanashiki | A47B 97/04 248/157 |
| 2004/0134110 | A1* | 7/2004 | Konny | G09F 15/0037 40/607.03 |
| 2004/0148831 | A1* | 8/2004 | Johnston | G09F 15/0037 40/607.03 |

(Continued)

*Primary Examiner* — Gary C Hoge

(74) *Attorney, Agent, or Firm* — Standley Law Group LLP

(57) ABSTRACT

A signage system is provided for use with load bearing poles. The system includes an upper pole section and a lower pole section, separable from the upper pole section. At least one upper flange block is positioned within the upper pole section and at least one lower flange block is positioned within the lower pole section. A load bearing shaft extends between or through each of the upper flange block and the lower flange block. Signage is coupled to or otherwise associated with the load bearing shaft, the signage being rotatable relative to at least one of the upper and lower pole sections.

21 Claims, 4 Drawing Sheets

(56) References Cited

U.S. PATENT DOCUMENTS

2011/0239500 A1* 10/2011 Gatuslao ..... G09F 11/02
40/473
2013/0008067 A1* 1/2013 DeMarco ..... G09F 15/0037
40/607.12
2013/0298432 A1* 11/2013 Gatuslao ..... G09F 7/22
40/473

* cited by examiner

SIGNAGE SYSTEM FOR STRUCTURAL POLES

PRIORITY CLAIM

Priority is claimed of and to U.S. Provisional Patent Application Ser. No. 62/043,997, filed Aug. 29, 2014, which is hereby incorporated herein by reference in its entirety.

BACKGROUND

Field of the Invention

The present invention relates generally to signage systems for advertising, promotion, information displays and the like. More particularly, the present invention relates to three-dimensional signage systems for use with load bearing poles.

SUMMARY OF THE INVENTION

In accordance with one aspect of the invention, a signage system is provided for use with load bearing poles. The system can include an upper pole section and a lower pole section, separable from the upper pole section. At least one upper flange block, can be positioned within the upper pole section and at least one lower flange block can be positioned within the lower pole section. A load bearing shaft can extend through each of the upper flange block and the lower flange block. Signage can be coupled to or otherwise associated with the load bearing shaft, the signage being rotatable relative to at least one of the upper and lower pole sections.

In accordance with another aspect of the invention, a method is provided for retrofitting a load bearing pole to include a signage system. The method can include: separating the load bearing pole into an upper and a lower pole section; installing an upper flange block within the upper pole section; installing a lower flange block within the lower pole section; positioning a load bearing shaft through each of the upper and lower flange block; and attaching signage to the load bearing shaft such that the signage is rotatable relative to at least one of the upper or lower pole sections.

In accordance with another aspect of the invention, a signage system for use with load bearing poles is provided, including an upper pole section and a lower pole section, separable from the upper pole section. At least one upper flange block can be positioned within the upper pole section and can be rotationally fixed relative to the upper pole section. At least one lower flange block can be positioned within the lower pole section and can be rotationally fixed relative to the lower pole section. A top flange block can be positioned within the upper pole section and a bottom flange block can be positioned within the lower pole section. A load bearing shaft can extend from the top flange block, through the upper flange block and the lower flange block, and to the bottom flange block. Signage can be coupled to the load bearing shaft, the signage being rotatable relative to at least one of the upper and lower pole sections.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1:
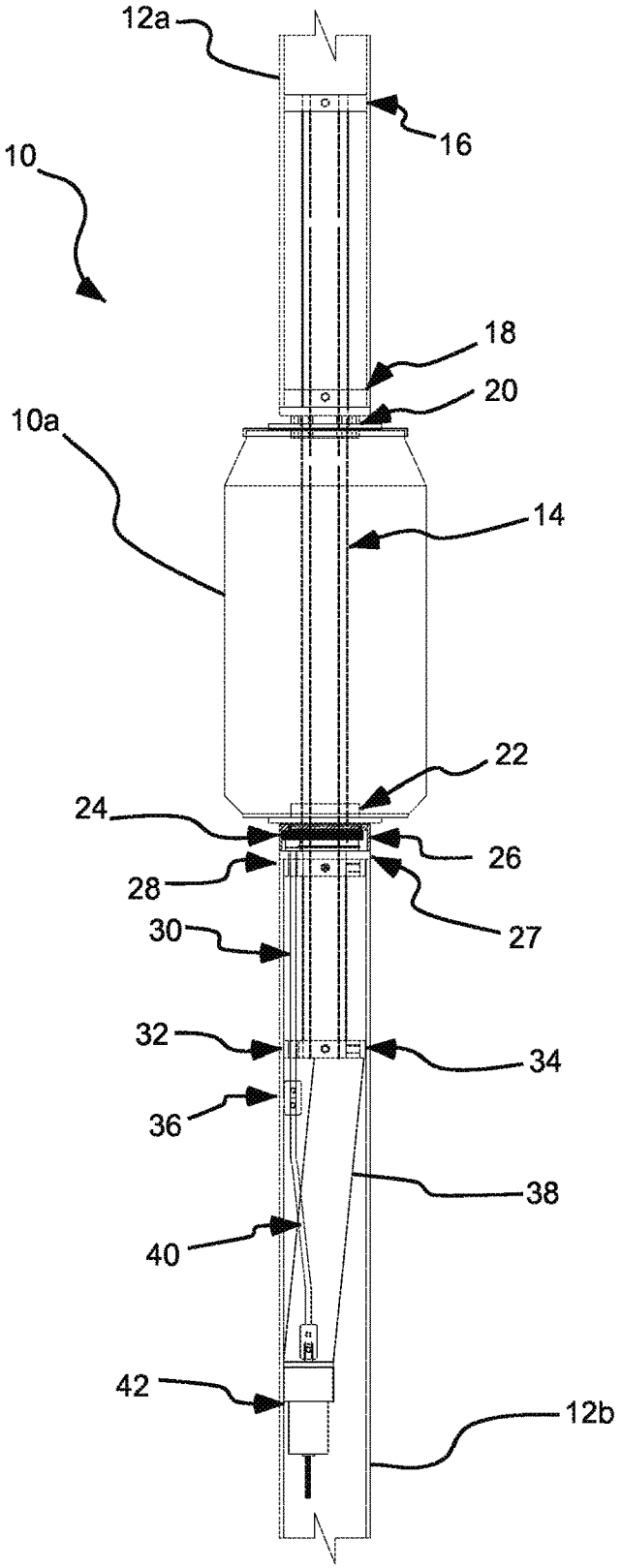
FIG. 1 is a side, partially sectioned view of a system in accordance with one aspect of the invention.
Figure 2A:
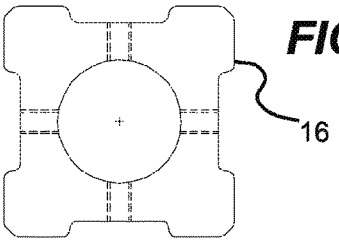
FIG. 2A is a top view of an exemplary top flange block in accordance with an embodiment of the invention.
Figure 2B:
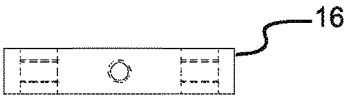
FIG. 2B is a side view of the top flange block of FIG. 2A.
Figure 3A:
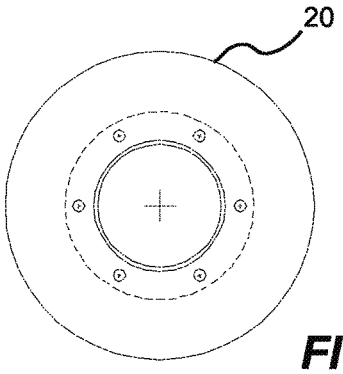
FIG. 3A is a top view of an exemplary top flange and bearing assembly in accordance with an embodiment of the invention.
Figure 3B:
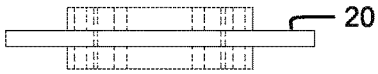
FIG. 3B is a side view of the top flange and bearing assembly of FIG. 3A.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENTS

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art to practice the invention, it should be understood that other embodiments may be realized and that various changes to the invention may be made without departing from the spirit and scope of the present invention.

In describing and claiming the present invention, the following terminology will be used.

The singular forms "a," "an," and "the" can include plural referents unless the context clearly dictates otherwise. Thus, for example, reference to "a flange" can, but doesn't not necessarily, include reference to one or more of such flanges.

As used herein, relative terms, such as "top," "bottom," "upper," "lower," "upwardly," "downwardly," etc., are used to refer to various components of the signage systems discussed herein, as those terms would be readily understood by one of ordinary skill in the relevant art. It is to be understood that such terms in no way limit the present invention but are used to aid in describing the components of the present systems in the most straightforward manner.

As used herein, the terms "signage" or "sign" or "signs" are to be understood to refer to a display of information that can be presented in a variety of manners. In some embodiments, the signage comprises a three-dimensional form representative of some object, such as a beverage can, automobile and the like. In other embodiments, the signage can be a relatively simple structure, such as a rectangular box or a cylinder on which information is displayed. Generally, such signage is provided with the ability to rotate relative to the pole with which it is associated. In this case (or in cases in which the signage is stationary), the term "signage" can include structure associated with such a display that is used to couple to the display to various other components of the pole structure. Thus, the term "signage" may encompass structural components associated with a display that may or may not directly display information, but do form a part of the structure of the display. A base plate on which a three-dimensional display is mounted is one example of such a structure.

As used herein, the term "substantially" refers to the complete or nearly complete extent or degree of an action, characteristic, property, state, structure, item, or result. As an arbitrary example, when an object or group of objects is/are referred to as being "substantially" symmetrical, it is to be understood that the object or objects are either completely symmetrical or are nearly completely symmetrical. The exact allowable degree of deviation from absolute completeness may in some cases depend on the specific context. However, generally speaking the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. As another arbitrary example, an opening that is "substantially free of" material would either completely lack material, or so nearly completely lack material that the effect would be the same as if it completely lacked material. In other words, an opening that is "substantially free of" material may still actually contain some such material as long as there is no measurable effect as a result thereof.

Invention

The present invention provides systems and methods by which load bearing poles, masts, columns or other structures can be provided with signage. Poles with which the present technology can be utilized range widely, but can include, without limitation, light poles, utility poles, architectural poles and the like. Such poles are generally designed to be used for purposes other than for advertising or display purposes. While conventional signage systems often require poles or masts to support the signage system, were it not for the signage system, such poles or masts would not be necessary. In contrast, the poles of the present invention generally serve some purpose other than to support the signage. For example, a light pole that supports a lighting system that provides illumination for a parking or pedestrian area; an architectural pole that provides support to an architectural structure, etc.

These types of poles are referred to herein as "load bearing poles". Under the present technology, such load bearing poles can be utilized for their intended purposes, yet still be provided with the signage features discussed herein. The present system can be utilized to retrofit existing poles, or to provide original installation poles. In either case, the load bearing pole can be used for some purpose that requires a specific load burden, and can also be utilized as part of an attractive and functional rotating signage system.

When various components are discussed herein as having the capability or capacity to carry the load otherwise carried by a load bearing pole (or segments of a load bearing pole), it is to be understood that reference is being made to the load bearing capacity of the pole or pole segments in a nominal configuration, in the absence of such other components. Thus, if a particular pole is segmented into an upper and lower pole section, the various components of the present technology installed within and/or between such segments are capable of carrying the load that the particular pole was originally capable of carrying, prior to use of the present technology.

The figures show generally various aspects of the present technology, with FIGS. 1 through 7B showing in detail various components that form a signage system 10 having a configuration that resembles beverage container 10*a*. Such a beverage container can be utilized, for example, to promote a particular brand of soda, beer or other beverage; or can be used to generally promote the sales of beverages. In this embodiment, the signage system can include an upper pole section 12*a* and a lower pole section 12*b*. The pole sections can be formed from typical materials used to form pole structures, such as tubular steel, aluminum, carbon fiber and the like. The pole sections are generally hollow, and thus can include hollow sections defined therein in which components of the present system can be installed, or can extend in or through.

The profile (e.g., cross-sectional shape) of the poles and thus the profiles of the upper and lower pole sections, can vary. They can include a circular or oval profile, or in the embodiment shown, can include a square profile. Note the shape, for example, of lower flange block 34 in FIG. 6, which corresponds to a square internal cross section of the pole. The upper pole section can be separable from the lower pole section to allow installation of the present technology. The pole sections can be separated on site by cutting a conventional load bearing pole with known technology: e.g., cutting torches, cutting saws and the like. In a retrofit application (one in which an existing load bearing pole is to be modified), the upper section can be cut from the lower section and laid upon a ground or other surface to allow the various components to be installed in the upper and lower pole sections. The sections can then be reassembled as shown.

Figure 4A:
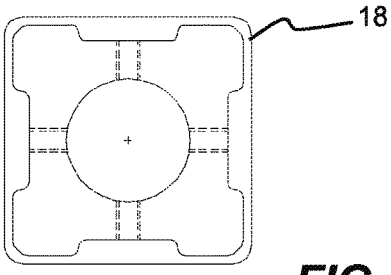
FIG. 4A is a top view of an exemplary upper flange block in accordance with an embodiment of the invention.
Figure 4B:
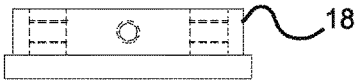
FIG. 4B is a side view of the upper flange block of FIG. 4A.
Figure 5A:
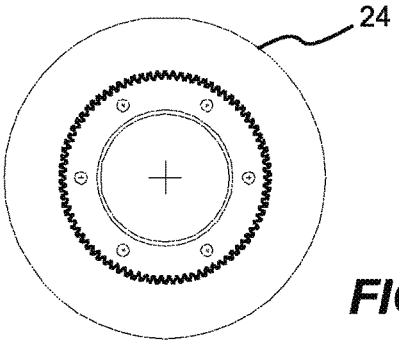
FIG. 5A is a top view of an exemplary pinion and reduction gear assembly in accordance with an embodiment of the invention.
Figure 5B:
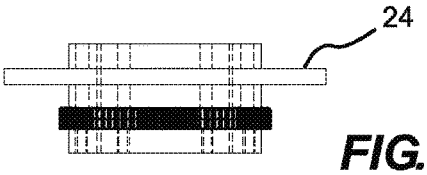
FIG. 5B is a side view of the assembly of FIG. 5A.

The components to be installed in the pole sections can include at least one upper flange block 18, shown by example in FIGS. 4A and 4B, which can be positioned within the upper pole section 12*a*. In the embodiment shown, the upper flange block is positioned within a throat of the upper pole section, flush with a bottommost portion of the upper pole section. A lower flange block 27, shown in FIGS. 7A and 7B, can likewise be positioned within the lower pole section 12*b* (in the throat of that section, if desired). A load bearing shaft 14 can extend through each of the upper flange block and lower flange block. The load bearing shaft provides a support to which signage (in this case soda can 10*a*) can be coupled to or otherwise associated with the load bearing shaft. The load bearing shaft can include a polished surface to allow the signage to easily rotate relative to at least one of the upper and lower pole sections. In the embodiment shown, the signage rotates relative to the load bearing shaft, which is stationary relative to the upper and lower pole sections.

In one embodiment, the load bearing shaft 14 can be partially or fully hollow. This can allow electric wires, communication cabling, etc., to pass through the signage from above and below. For example, wiring or cabling can extend from the upper pole section 12*a*, through the load bearing shaft 14, and into the lower pole section 12*b*. Also, where desired, the load bearing shaft can include one or more holes or openings (not shown in detail) formed therein. Such openings can allow wires or cables to extend outwardly from and inwardly to the hollow space within the load bearing shaft. This can be advantageous, for example, when it is desired to extend such wires into a space defined within the three-dimensional signage, to provide power or communication to various objects disposed within the three-dimensional signage (e.g., lights, communication equipment, etc., as discussed in more detail below).

While the embodiment shown provides a stationary load bearing shaft 14, it is also contemplated that the load bearing shaft can rotate relative to the upper 12*a* and lower 12*b* pole sections, with minor modifications to the various components described herein. Such a configuration would be readily appreciated by one of ordinary skill in the art having possession of this disclosure.

The system can also include a removable top flange 16 (FIGS. 2A and 2B) that can serve to provide further support for the load bearing shaft 14. A top flange and bearing assembly 20 (FIGS. 3A and 3B) can be provided, that can be coupled to the upper flange block 18 (FIGS. 4A and 4B). The top flange and bearing assembly 20 can allow the signage to rotate relative to the upper flange block 18 (which results in the signage being rotatable relative to the upper pole section 12*a*). A lower flange and bearing assembly 22 (FIG. 1) can be coupled to the lower flange block 27 (FIGS. 7A and 7B) and can similarly provide rotatability relative to the lower pole section 12*b*.

Figure 6:
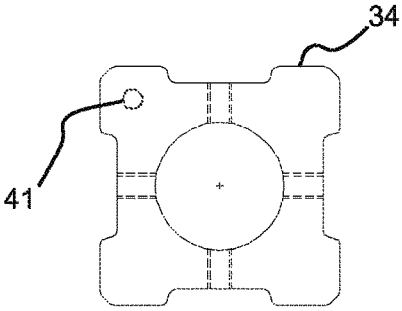
FIG. 6 is a top view of an exemplary bottom flange block in accordance with an embodiment of the invention.
Figure 7A:
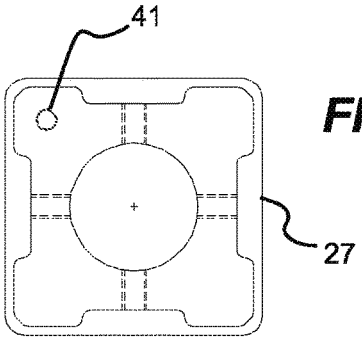
FIG. 7A is a top view of an exemplary lower flange block in accordance with an embodiment of the invention.
Figure 7B:
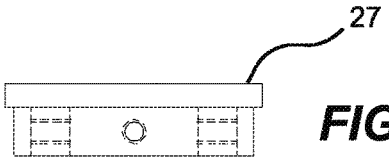
FIG. 7B is a side view of the lower flange block of FIG. 7A.

A pinion and reduction gear 24 (FIGS. 5A and 5B) can be disposed between the lower flange and bearing assembly 22 and the lower flange block 27. The pinion and reduction gear is in turn coupled to drive shaft 30, which can be, but is not necessarily, solid. The drive shaft 30 extends through bottom flange block 34 (FIG. 6) through, for example, a bushing 32 (FIG. 1). As shown in FIG. 1, drive shaft 30 can be coupled to flexible drive cable 40, which is in turn coupled to motor 42. In the example shown, the motor is an electric motor that provides rotational output to drive cable 40. FIGS. 6 and 7A provide an example of the drive cable extending through the bottom flange block and the lower flange block, respectively, via hole or opening 41.

In the embodiment shown, the flange blocks 16, 18, 27 and 34 are fixed relative to the upper 12*a* and lower 12*b* pole sections. They can be fixed within the pole sections in a variety of manners, including welding, the use of fasteners, etc. Each of these components can also be fixed to the load bearing shaft 14. In the example shown, sets screws are used to fix the various flanges to the shaft, as perhaps best appreciated from the various views provided in FIGS. 2A through 7B. Thus, the shaft is fixed relative to the pole sections (and thus to the overall pole structure). The drive motor 42 can also be fixed relative to the lower pole section 12*b*, via motor bracket 38 (see FIG. 1).

As motor 42 is energized, it rotates flexible drive 40, which is in turn coupled to the drive shaft 30 that also rotates. Note that drive shaft 30 extends through fixed flange blocks 34 and 27 via holes 41 (FIGS. 6 and 7A) into which bushings 38, 32 can be installed. Thus, as motor 42 provides rotational output, this output is transferred to the pinion and reduction gear assembly 24. As this assembly is rotated, lower flange and bearing assembly 22 is rotated. As the signage 10*a* is coupled to the lower flange and bearing assembly 22, this causes the signage 10*a* to rotate. Note also that top flange and bearing assembly 20 can rotate. In this manner, the rotating components are securely attached to the load bearing pole, but can rotate freely to provide an aesthetically pleasing and structurally sound installation.

Various components can be utilized to weatherproof the installation, including watertight gear cover 26 (FIG. 1), which can prevent moisture from entering the lower pole section 12*b*. A similar arrangement can be accomplished with the upper pole section 12*a*, although it will generally not be as susceptible to water entry as will the lower pole section.

Each of the various components discussed above can be relatively easily installed within existing load bearing poles or masts, or in newly installed poles or masts. Power can be provided to the motor shown through various means. In many cases, the existing load bearing pole will already include a power source (for light 52, for example, shown in FIG. 8). This power source can be used to power the motor, and also various auxiliary components (not shown in detail). While not so required, in one aspect of the invention, a backup power pack (battery pack) can be provided. One such exemplary pack is shown at 62 in FIG. 8: in this case, the power pack is stored within the upper pole section 12*a*, to provide concealment of and protection for the power pack.

Auxiliary components for use with the present technology can include, for example, lighting for the signage (which can be installed within the three-dimensional body), communication components, such as "Wi-Fi" components, antennas, audio systems to provide audible hailing to nearby customers, and the like. As the interior of the three-dimensional body (e.g., 10*a* and 10*b*) is substantially waterproof, it provides an excellent space for installation and operation of such auxiliary components. Surveillance cameras can also be strategically located within (and thus concealed by) the three-dimensional body, if so desired. One exemplary surveillance camera is shown on the exterior of the pole/lighting structure at 60 in FIG. 8. A variety of lighting options can also be provided, to provide a steady light source, flashing lights, etc.

Figure 8:
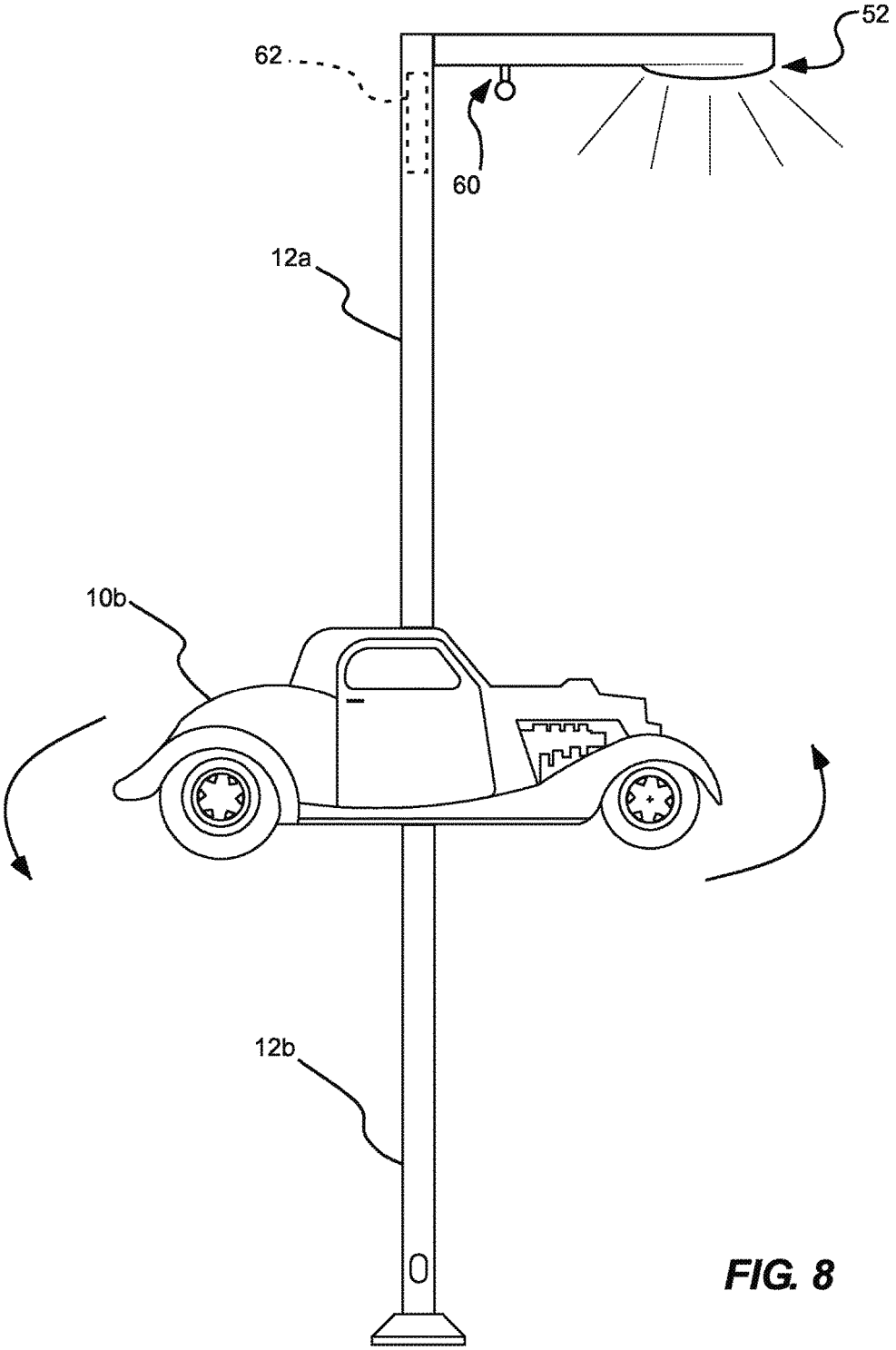
FIG. 8 is a side view of an exemplary installation in accordance with an aspect of the invention.

FIG. 8 illustrates another exemplary signage configuration, depicting an automobile 10*b*. While a beverage can and automobile are shown as examples, it is to be understood that a variety of configurations can be provided, and can be tailored to a particular vendor's liking. Due to the efficient design of the present system, the signage can be relatively easily changed or replaced, once the overall system has been installed.

While the various signage discussed above is referred to as being "rotatable" with respect to the overall pole installation, the amount of rotation for any particular application can vary. For example, in some cases the signage 10*a*, 10*b* can rotate completely (and, for example, continuously) about a 360-degree rotation in a constant direction of rotation. In other embodiments, the signage may rotate in first one direction, and then reverse and rotate in a counter direction. In some cases, the signage rotates only a fraction of a full rotation, and essentially oscillates between two or more angular positions. For example, the signage may rotate 15 degrees in one direction, then 15 degrees in the opposite direction, and continuously repeat this cycle. The angular displacement of such oscillation can vary from a few degrees to 360-degrees or more.

One or more controllers (not shown in detail) can be provided to control the motor to achieve these varying patterns of rotation. The controller can control the angular magnitude of oscillation, the speed of rotation, varying patterns of oscillation, etc. The controller can also be functionally connected to other operational aspects of the system, such as lighting, to allow an operator to control a variety of aspects of operation. This can be accomplished either through local input, or remotely, and can be a hard-wired system or wireless system of control.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

We claim:

1. A signage system for use with load bearing poles, comprising:

an upper pole section;

a lower pole section, separable from the upper pole section;

at least one upper flange block and at least one top flange block positioned within the upper pole section;

at least one lower flange block and at least one bottom flange block positioned within the lower pole section;

a load bearing shaft, the load bearing shaft extending through the upper flange block to the top flange block and through the lower flange block to the bottom flange block; and signage, coupled to the load bearing shaft, the signage being rotatable relative to at least one of the upper and lower pole sections.

2. The system of claim 1, further comprising a motor, coupled to the signage, the motor providing rotatability to the signage.

3. The system of claim 2, wherein the motor is coupled within one of the upper or lower pole sections, and further comprising a drive shaft extending from the motor to the signage.

4. The system of claim 1, wherein the upper and lower flange blocks, the motor, and the drive shaft are all contained within, and concealed from view by, one of the upper or lower pole sections.

5. The system of claim 1, wherein the upper and lower flange blocks and the load bearing shaft are collectively capable of carrying loads at least equal to loads carried by a pole formed from the upper and lower pole sections.

6. The system of claim 1, wherein the signage comprises a three-dimensional representation of an object.

7. The system of claim 1, wherein the top flange block, bottom flange block, upper flange block and lower flange block are rotationally fixed relative to the upper and lower pole sections.

8. The system of claim 1, wherein the upper flange block is rotationally fixed relative to the upper pole section, and wherein the lower flange block is rotationally fixed relative to the lower pole section.

9. A method for retrofitting a load bearing pole with a signage system, comprising:

separating the load bearing pole into an upper and a lower pole section;

installing an upper flange block within the upper pole section;

installing a lower flange block within the lower pole section;

positioning a load bearing shaft through each of the upper and lower flange blocks; and attaching signage to the load bearing shaft such that the signage is rotatable relative to at least one of the upper and lower pole sections.

10. The method of claim 9, wherein the upper flange block is installed in a throat of an exposed end of the upper pole section, and wherein the lower flange block is installed in a throat of an exposed end of the lower pole section.

11. The method of claim 9, wherein the load bearing shaft extends through each of the flange blocks into a hollow interior of the upper and lower pole sections.

12. The method of claim 9, further comprising mounting a motor within one of the upper or lower pole sections, the motor providing rotatability to the signage.

13. The method of claim 9, wherein the signage comprises a three-dimensional representation of an object.

14. A signage system for use with load bearing poles, comprising:

an upper pole section;

a lower pole section, separable from the upper pole section;

at least one upper flange block, positioned within the upper pole section and being rotationally fixed relative to the upper pole section;

at least one lower flange block, positioned within the lower pole section and being rotationally fixed relative to the lower pole section;

a top flange block, positioned within the upper pole section and a bottom flange block, positioned within the lower pole section;

a load bearing shaft, extending from the top flange block, through the upper flange block and the lower flange block, and to the bottom flange block; and signage, coupled to the load bearing shaft, the signage being rotatable relative to at least one of the upper and lower pole sections.

15. The system of claim 14, further comprising a motor, coupled to the signage, the motor providing rotatability to the signage.

16. The system of claim 15, wherein the motor is coupled within one of the upper or lower pole sections, and further comprising a drive shaft extending from the motor to the signage.

17. The system of claim 14, wherein the upper and lower flange blocks, the motor, and the drive shaft are all contained within, and concealed from view by, one of the upper or lower pole sections.

18. The system of claim 14, wherein the upper flange block, lower flange block, top flange block, bottom flange block, and the load bearing shaft are collectively capable of carrying loads at least equal to loads carried by a pole formed from the upper and lower pole sections.

19. The system of claim 14, wherein the signage comprises a three-dimensional representation of an object.

20. A signage system for use with load bearing poles, comprising:

an upper pole section a lower pole section, separable from the upper pole section;

at least one upper flange block, positioned within the upper pole section;

at least one lower flange block, positioned within the lower pole section;

a load bearing shaft, extending from the upper flange block to the lower flange block;

signage, the signage coupled to the load bearing shaft and being rotatable relative to at least one of the upper and lower pole sections; and a motor mounted within one of the upper or lower pole sections, the motor providing rotatability to the signage and including a drive shaft extending from the motor to the signage and coupling the motor thereto.

21. A method for retrofitting a load bearing pole with a signage system, comprising:

separating the load bearing pole into an upper and a lower pole section;

installing an upper flange block within the upper pole section;

installing a lower flange block within the lower pole section;

positioning a load bearing shaft through each of the upper and lower flange blocks;

attaching signage to the load bearing shaft such that the signage is rotatable relative to at least one of the upper and lower pole sections; and mounting a motor within one of the upper or lower pole sections, the motor providing rotatability to the signage.

* * * * *